US008702440B2

(12) United States Patent
Nooner et al.

(10) Patent No.: US 8,702,440 B2
(45) Date of Patent: Apr. 22, 2014

(54) ELECTRICAL CORD CONNECTION COVERING TECHNIQUES

(75) Inventors: Bryan Nooner, Orland Park, IL (US); Robert Zajeski, Homer Glen, IL (US)

(73) Assignee: Midwest Innovative Products, LLC, Orland Park, IL (US)

( * ) Notice: Subject to any disclaimer, the term of this patent is extended or adjusted under 35 U.S.C. 154(b) by 23 days.

(21) Appl. No.: 13/597,590

(22) Filed: Aug. 29, 2012

(65) Prior Publication Data

US 2013/0052890 A1 Feb. 28, 2013

Related U.S. Application Data

(60) Provisional application No. 61/528,456, filed on Aug. 29, 2011.

(51) Int. Cl.
*H01R 13/52* (2006.01)

(52) U.S. Cl.
USPC ..... 439/279; 439/367; 439/893; 439/457; 439/521

(58) Field of Classification Search
USPC ..... 439/165, 279, 282, 367, 370, 371, 372, 439/456, 457, 521, 893
See application file for complete search history.

(56) References Cited

U.S. PATENT DOCUMENTS

| | | | | |
|---|---|---|---|---|
| 3,344,393 | A | 9/1967 | Hendee | |
| 4,066,321 | A | 1/1978 | Villazon | |
| 5,217,387 | A * | 6/1993 | Hull et al. | 439/367 |
| 5,259,782 | A | 11/1993 | Giffin | |
| 6,250,946 | B1 | 6/2001 | Tardy | |
| D466,088 | S * | 11/2002 | Saben | D13/154 |
| 7,189,100 | B1 * | 3/2007 | Colbourne | 439/369 |
| 7,465,182 | B1 | 12/2008 | McDonald | |
| 7,553,181 | B1 * | 6/2009 | Van Dalinda, III | 439/369 |
| 2005/0147361 | A1 * | 7/2005 | Hovland et al. | 385/94 |
| 2013/0052890 | A1 * | 2/2013 | Nooner et al. | 439/892 |
| 2013/0165002 | A1 * | 6/2013 | Nooner | 439/892 |

OTHER PUBLICATIONS

International Search Report and the Written Opinion of the International Searching Authority (PCT), 12 pgs., Nov. 14, 2012.

* cited by examiner

*Primary Examiner* — James Harvey
(74) *Attorney, Agent, or Firm* — McAndrews, Held & Malloy, Ltd.

(57) ABSTRACT

An electrical cord covering system may include a first covering portion, a second covering portion, and a compression portion. Each of the covering portions may have an interior region, a cable aperture, a plug aperture, and a mating portion. The interior region of each covering portion may house a portion of a cable and a plug of a respective electrical cord. The cable aperture of each covering portion can accommodate the cable of the respective electrical cord. The plug aperture of each covering portion may permit the plugs of the different electrical cords to mate. The mating portions may allow the covering portions to mate. The compression portion may nest within the interior regions of the covering portions and accommodate the plugs. When the covering portions are mated, the compression portion may form seals at the cable apertures of the covering portions.

13 Claims, 8 Drawing Sheets

ELECTRICAL CORD CONNECTION COVERING TECHNIQUES

CROSS REFERENCE TO RELATED APPLICATIONS

This application claims priority to U.S. Patent Application Ser. No. 61/528,456, filed on Aug. 29, 2011, the entirety of which is herein incorporated by reference. This application is also related to PCT/US2012/052795 filed on Aug. 29, 2012 and U.S. Pat. Ser. No. 13/772,859 filed on Feb. 21, 2013.

FEDERALLY SPONSORED RESEARCH OR DEVELOPMENT

[Not Applicable]

JOINT RESEARCH AGREEMENT

[Not Applicable]

SEQUENCE LISTING

[Not Applicable]

BACKGROUND OF THE APPLICATION

Generally speaking, this application discloses techniques relating to weatherproofing plug connections for electrical cords, such as extension cords or decorative lighting cords.

It MAY BE desirable to keep moisture from interfering with electrical cord plug connections. If such a connection is corrupted by moisture, short circuits to ground may occur causing a potentially dangerous condition or causing circuit breakers, fuses, or ground-fault interrupt protection circuits to prevent the flow of current through the electrical cord. For example, outdoor holiday lighting often involves the use of multiple plug connections in an environment with unfavorable environmental conditions (for example, snow, melting snow, fog, sleet, freezing rain, rain, extreme temperatures, salt, etc.).

One attempted solution to these problems is shown in FIGS. 4A-4C. A gasket is placed between male and female cord plugs and a plastic housing is connected around the plug connection. The gasket mechanism may be relatively small (for example, about the size of a quarter or a little thicker than a penny) and may not be sufficiently durable under unfavorable environmental conditions, especially when exposed to a substantial amount of moisture. As another example, the plastic housing may not be effective at keeping out moisture (for example, moisture may be able to penetrate through the housing connections and through the holes where the cord cables run).

Figure 1A:
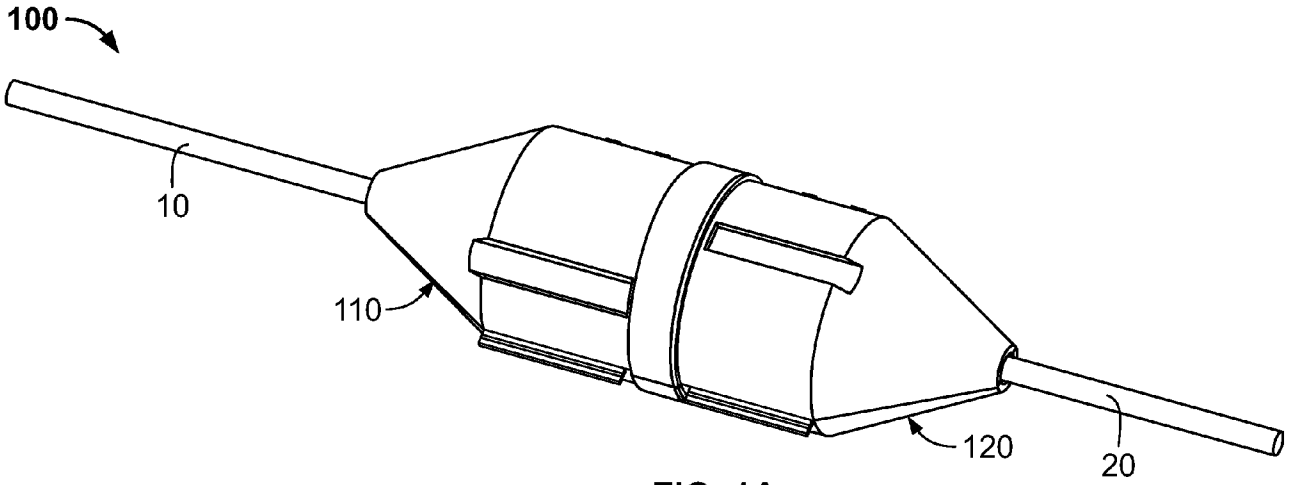
FIG. 1A shows a perspective view of a system for covering a connection of electrical cords in which two covering portions are mated, according to techniques of the present application.
Figure 1B:
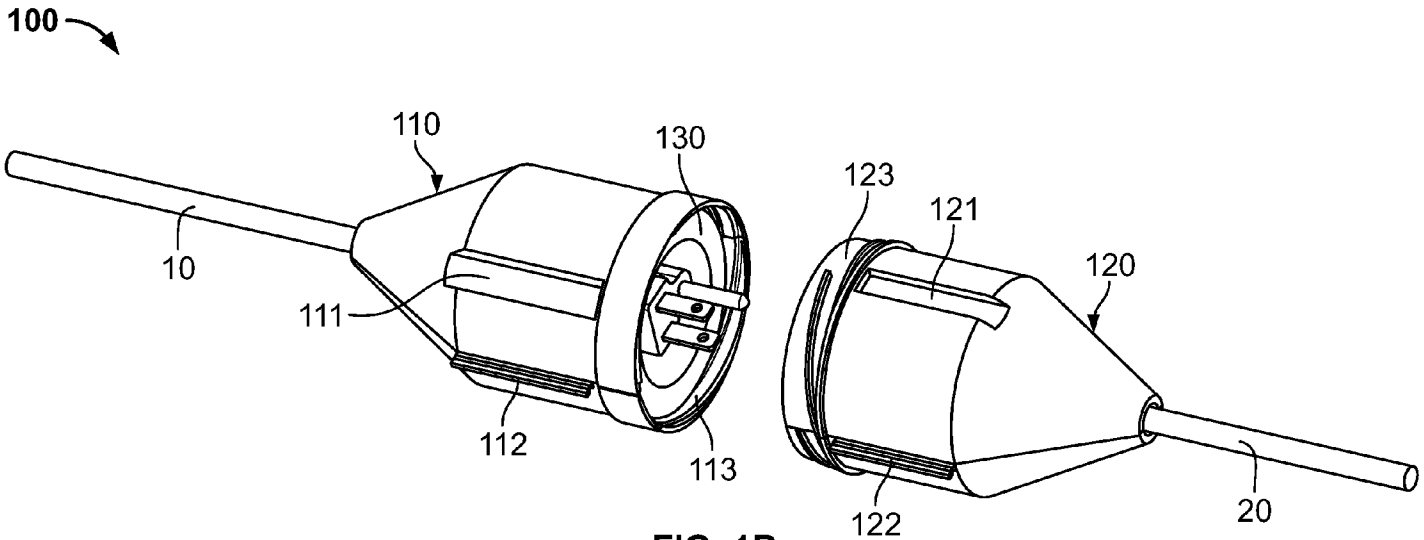
FIG. 1B shows a perspective view of a system for covering a connection of electrical cords in which two covering portions are not mated, according to techniques of the present application.
Figure 1C:
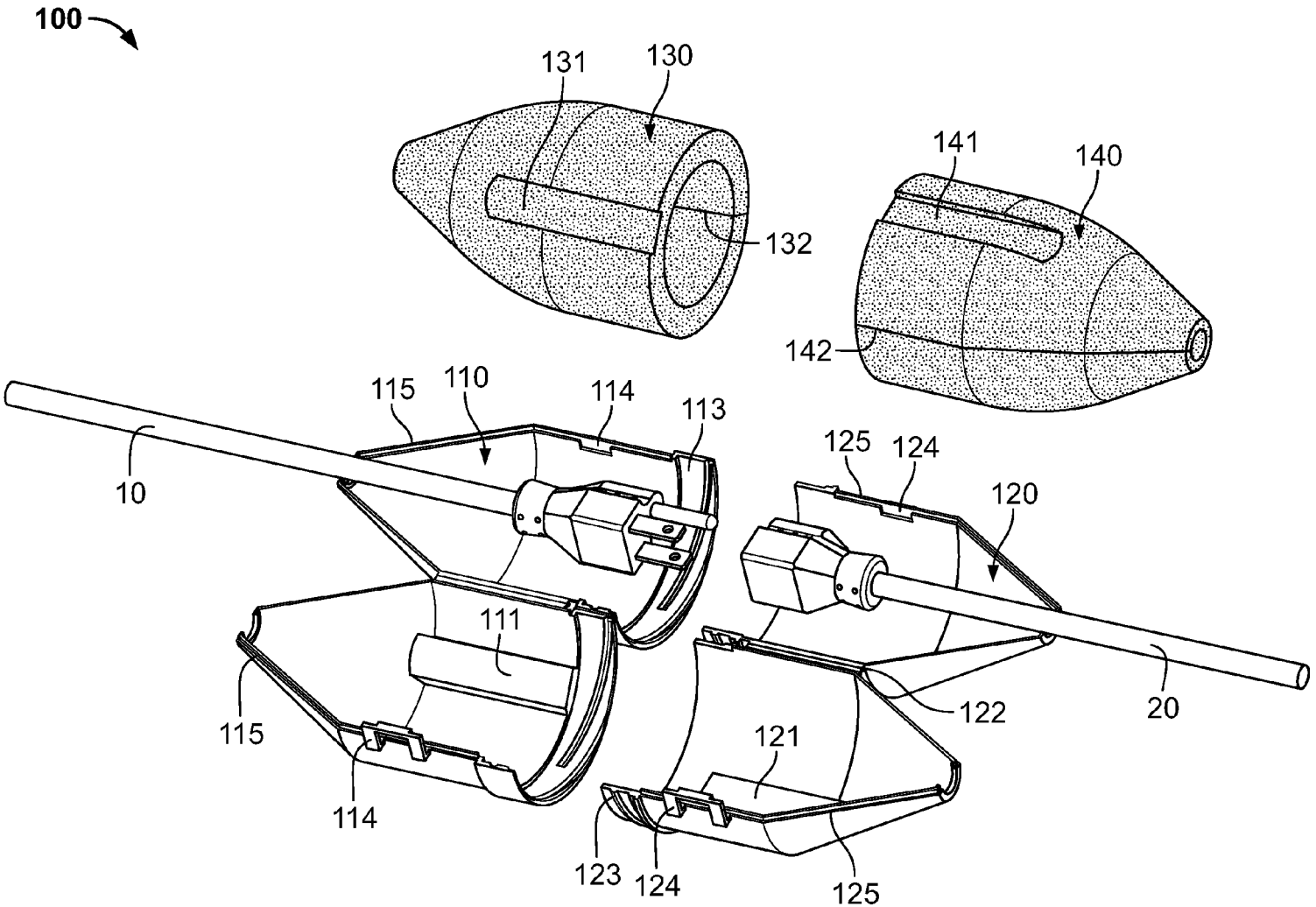
FIG. 1C shows a perspective view of a system for covering a connection of electrical cords in which two covering portions are not mated, according to techniques of the present application.

The foregoing summary, as well as the following detailed description of certain techniques of the present invention, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE APPLICATION

FIGS. 1A-1E show a system 100 for covering an electrical cord connection, according to techniques of the present application. The system 100 may include a first covering portion 110, a second covering portion 120, a first compression portion 130, and a second compression portion 140. The covering portions 110, 120 may be plastic. The covering portions 110, 120 may have a funnel-like shape. The compression portions 130, 140 may be foam and may have a funnel-like shape.

The first covering portion 110 may have an interior region, a cable aperture, a plug aperture, and a mating portion 113 proximate to the plug aperture. The interior region may house a portion of a cable 10 and a plug 11 of a first electrical cord. The cable aperture may accommodate the cable 11 of the first electrical cord. The plug aperture may be arranged to permit the plug 11 of the first electrical cord to mate with a plug 21 of a second electrical cord. The first covering portion 110 may also have a hinge 112 (for example, a living hinge), a sealing ridge 115, a keyway 111, and a securing portion 114. It should be understood that references to components or portions of the first covering portion 110 may refer to one or more of such components or portions (for example, hinge 112, sealing ridge 115, keyway 111, and securing portion 114). The hinge 112 and securing portion 114 may allow the first covering portion 110 to be shaped as a clam shell with two casing halves. The securing portion 114 may allow the two casing halves to securely open and close to seal the sealing ridge 115. The securing portion 114 may be integrated into the first covering portion 110 and may include snap locks.

The second covering portion 120 may have an interior region, a cable aperture, a plug aperture, and a mating portion 123 proximate to the plug aperture. The interior region may house a portion of a cable 20 and a plug 21 of a second electrical cord. The cable aperture may accommodate the cable 20 of the second electrical cord. The plug aperture may be arranged to permit the plug 21 of the second electrical cord to mate with a plug 11 of the first electrical cord. The second covering portion 120 may also have a hinge 122 (for example, a living hinge), a sealing ridge 125, a keyway 121, and a securing portion 124. It should be understood that references to components or portions of the second covering portion 120 may refer to one or more of such components or portions (for example, hinge 122, sealing ridge 125, keyway 121, and securing portion 124). The hinge 122 and securing portion 124 may allow the second covering portion 120 to be shaped as a clam shell with two casing halves. The securing portion 124 may allow the two casing halves to securely open and close to seal the sealing ridge 125. The securing portion 124 may be integrated into the second covering portion 120 and may include snap locks.

The first compression portion 130 may include an access slit 132 and a keyway 131. The first compression portion 130 may nest (at least partially) within the interior region of the first covering portion 110. The first compression portion 130 may surround the portion of the cable 10 and the plug 11 of the first electrical cord accommodated by the interior region of the first covering portion 110. The access slit 132 may facilitate this surrounding arrangement by allowing the electrical cord 10 to pass through a lateral wall of the first compression portion 130.

The second compression portion 140 may include an access slit 142 and a keyway 141. The second compression portion 140 may nest (at least partially) within the interior region of the second covering portion 120. The second compression portion 140 may surround the portion of the cable 20 and the plug 21 of the second electrical cord accommodated by the interior region of the second covering portion 120. The access slit 142 may facilitate this surrounding arrangement by allowing the electrical cord 20 to pass through a lateral wall of the second compression portion 140.

The compression portions 130, 140 may include foam such as closed-cell foam, which may inhibit or prevent the absorption of liquids such as water. The foam may repel water, which may bead once hitting the foam and then roll off of the foam. Due to the compressibility of the foam, the compression portions 130, 140 may be self-adjusting, thereby facilitating the formation of seals around different size cords or wires, such as 14, 16, 18, 20, 22, or 24 gauge wires or cords.

Figure 1D:
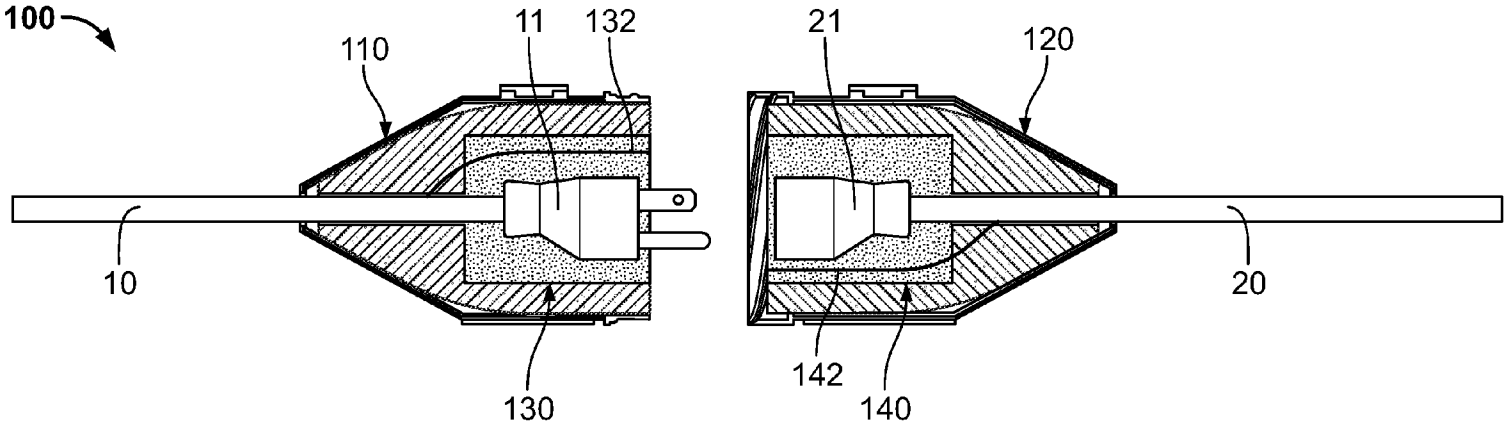
FIG. 1D shows a cross-sectional view of a system for covering a connection of electrical cords in which two covering portions are not mated, according to techniques of the present application.
Figure 1E:
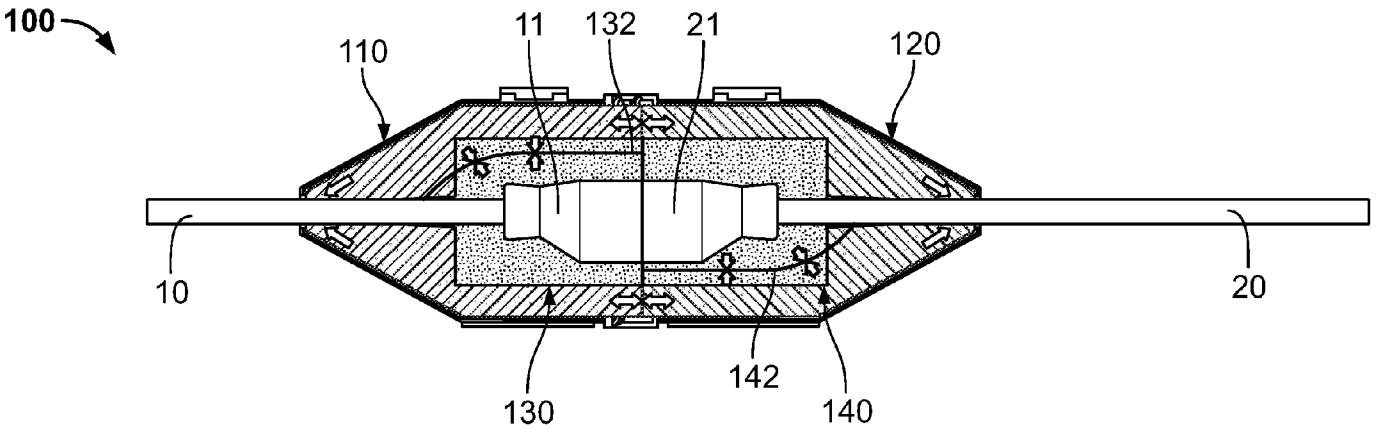
FIG. 1E shows a cross-sectional view of a system for covering a connection of electrical cords in which two covering portions are mated, according to techniques of the present application.

FIG. 1D shows a cross-sectional view of the system 100 before the covering portions 110, 120 are mated. FIG. 1E shows a cross-sectional view of the system 100 after the covering portions 110, 120 are mated. After mating via the mating portions 113 and 123, the first compression portion 130 may compress (as illustrated by the arrows in FIG. 1E) and fill in voids in the interior region of the first covering portion 110 (for example, near the cable aperture). This compression (for example, radial compression) may also form seals at the cable aperture and at the access slit 132. Similarly, the second compression portion 140 may compress and fill in voids in the interior region of the second covering portion 120. This compression may also form seals at the cable aperture and at the access slit 142.

Additionally, when the mating portions 113, 123 are mated, the first and second compression portions 130, 140 may compress against each other and a seal may be formed at the plug apertures and around the mated plugs 11, 21. The mating portions 113, 123 may mate by screwing (for example, ¼ turn). As the covering portions 110, 120 are connected they may exert a radial compression force upon the compression portions 130, 140 causing them to fill in the voids around the cables 10, 20 and the other openings along the compression portions 130, 140, resulting in a substantially water or weather resistant seal around the electrical connection between the plugs 11, 21. The compression portions 130, 140 may be slightly larger than the respective covering portions 110, 120. This may facilitate compression once the first and second covering portions 110, 120 are mated.

The keyways 111, 121 of the covering portions 110, 120 may also facilitate preventing moisture from seeping into the electrical connection between the plugs 11, 21. In order to have the compression portions 130, 140 nest in a particular orientation to the respective covering portions 110, 120, keyways 131, 141 may be employed. The compression portions 130, 140 may have keyways 131, 141 that match the respective keyways 111, 121 on the covering portions 110, 120. By maintaining a particular orientation of the compression portions 130, 140 with respect to the covering portions 110, 120, the slits 132 may be positioned or rotated away from the sealing ridges 115 of the covering portions 110, 120. The keyways 111, 121, 131, 141 may also provide an indicator whether the covering portions 110, 120 are mated or not.

The system shown in FIGS. 1A-1E may be used in the following manner. The cables 10, 20 and plugs 11, 21 of the first/second electrical cords are placed in the respective first/second compression portions 130, 140. This is facilitated by the slits 132, 142. The first/second compression portions 130, 140 are then placed in the respective first/second covering portions 110, 120. The keyways 111, 121, 131, 141 of the compression portions 130, 140 and the covering portions 110, 120 maintain a desirable orientation to prevent the slits 132, 142 from lining up with the sealing ridges 115, 125. The covering portions 110, 120 are closed and secured around the compression portions 130, 140.

The covering portions 110, 120 are screwed together. This causes the compression portions 130, 140 to compress. The compression causes various seals to be made—for example, seals around the cable apertures, plug apertures, sealing ridges, etc. Additionally, the compression portions 130, 140 compress against each other causing an additional compression seal.

FIGS. 2A-2E show a system 200 for covering an electrical cord connection, according to techniques of the present application. The system 200 may include a first covering portion 210, a second covering portion 220, a compression portion 230. The covering portions 210, 220 may be plastic. The covering portions 210, 220 may have a funnel-like shape. The compression portion 230 may be foam and may have one or more funnel-like shapes. The compression portion 230 may be formed of two compression portions, such compression portions 130, 140.

The first covering portion 210 may have an interior region, a cable aperture, a plug aperture, and a mating portion 213 proximate to the plug aperture. The interior region may house a portion of a cable 10 and a plug 11 of a first electrical cord. The cable aperture may accommodate the cable 10 of the first electrical cord. The plug aperture may be arranged to permit the plug 11 of the first electrical cord to mate with a plug 21 of a second electrical cord. The first covering portion 210 may also have a hinge 212 (for example, a living hinge), a sealing ridge 217, and a securing portion 214. It should be understood that references to components or portions of the first covering portion 210 may refer to one or more of such components or portions (for example, hinge 212, sealing ridge 217, and securing portion 214). The hinge 212 and securing portion 214 may allow the first covering portion 210 to be shaped as a clam shell with two casing halves. The securing portion 214 may allow the two casing halves to securely open and close to seal the sealing ridge 217. The securing portion 214 may be integrated into the first covering portion 210 and may include snap locks.

The second covering portion 220 may have an interior region, a cable aperture, a plug aperture, and a mating portion 223 proximate to the plug aperture. The interior region may house a portion of a cable 20 and a plug 21 of a second electrical cord. The cable aperture may accommodate the cable 20 of the second electrical cord. The plug aperture may be arranged to permit the plug 21 of the second electrical cord to mate with a plug 11 of the first electrical cord. The second covering portion 220 may also have a hinge 222 (for example, a living hinge) a sealing ridge 227, and a securing portion 224. It should be understood that references to components or portions of the second covering portion 220 may refer to one or more of such components or portions (for example, hinge 222, sealing ridge 227, and securing portion 224). The hinge 222 and securing portion 224 may allow the second covering portion 220 to be shaped as a clam shell with two casing halves. The securing portion 224 may allow the two casing halves to securely open and close to seal the sealing ridge 227. The securing portion 224 may be integrated into the second covering portion 220 and may include snap locks.

The first and second covering portions 210, 220 may include other connectors, such as radial lock(s). The radial locks may include nubs 215 and mating tabs 225 (for example, four pairs of nubs 215 and tabs 225). While the nubs 215 are depicted on the first covering portion 210 and the mating tabs 225 are depicted on the second covering portion 220, the reverse may also be possible.

Figure 3A:
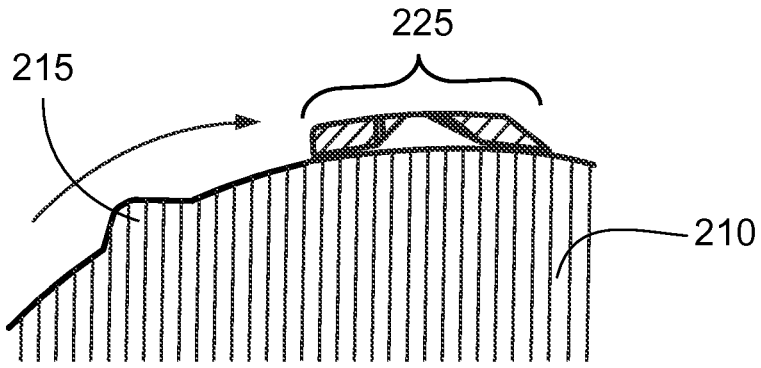
FIG. 3A shows a cross-sectional view of a radial locking system, according to techniques of the present application.
Figure 3B:
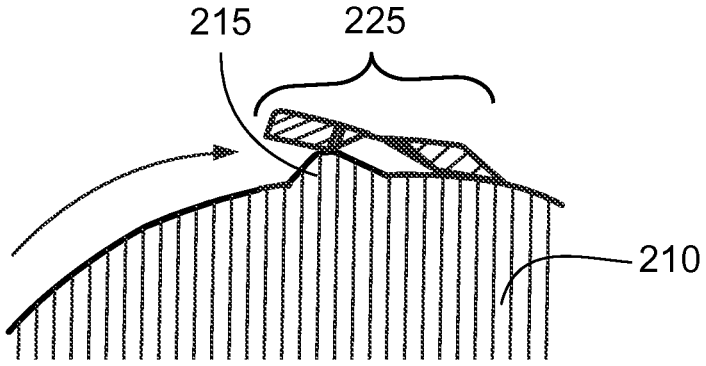
FIG. 3B shows a cross-sectional view of a radial locking system, according to techniques of the present application.
Figure 3C:
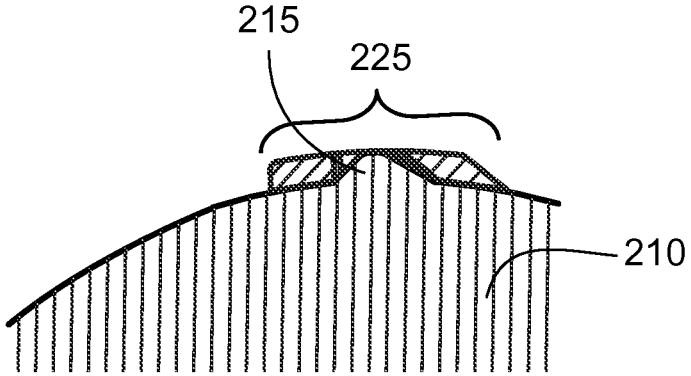
FIG. 3C shows a cross-sectional view of a radial locking system, according to techniques of the present application.
Figure 4A:
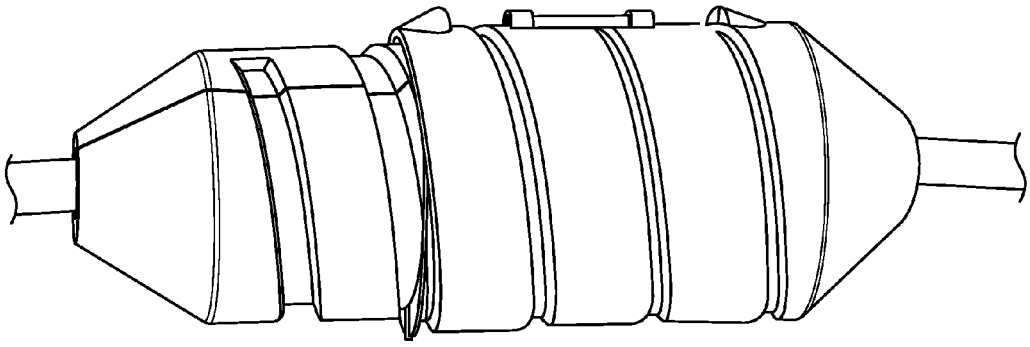
FIG. 4A (Prior Art)
FIG. 4A shows a side view of a prior art covering for an electrical cord connection.
Figure 4B:
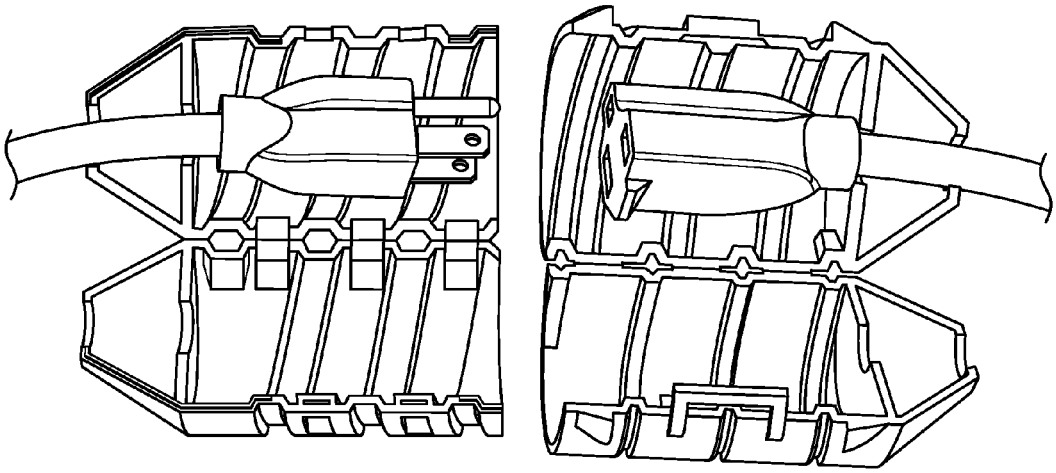
FIG. 4B (Prior Art)
FIG. 4B shows a side view of a prior art covering for an electrical cord connection.
Figure 4C:
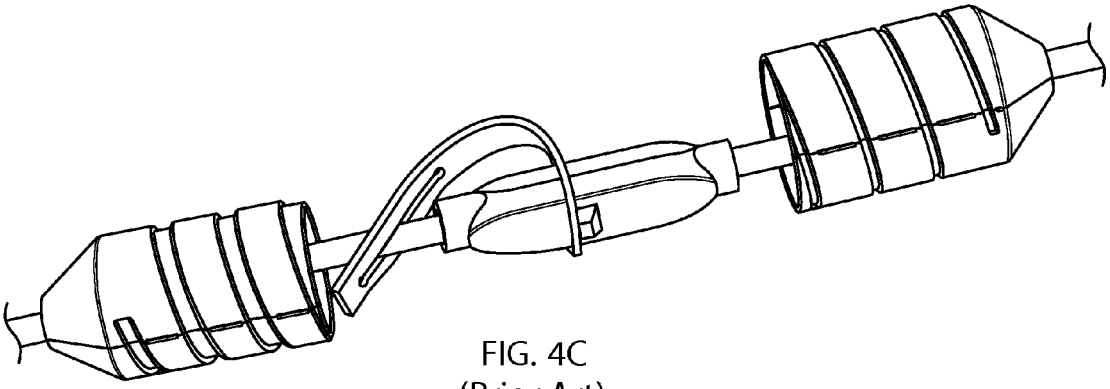
FIG. 4C (Prior Art)
FIG. 4C shows a side view of a prior art covering for an electrical cord connection.

The nubs 215 and tabs 225 may mate as a result of twisting and mating the covering portions 210, 220. Referring to FIGS. 3A-3C, as the portions 210, 220 are twisted together, a given nub 215 may force a tab 225 outwardly away from the covering portion 220. The tab 225 may then become compressed. The tab 225 may have an opening that receives the nub 215. As the nub 215 enters this opening, the tab 225 may at least partially decompress, thereby "locking" the nub 215 and tab 225. The height of the nub 215 may be approximately the same as the height of the tab 225.

The nub 215 may have a side with a shallow slope and a side with a steep slope. The shallow slope may be "shallow" in that it may be shallower than the steep slope. Similarly, the steep slope may be "steep" in that it may be steeper than the shallower slope. The shallower slope side of the nub 215 may be employed to compress the tab 225 when going from an unlocked to a locked state. This may reduce the amount of torque needed to lock the radial locking system by causing the tab 225 to more gradually compress as the nub 215 moves underneath the tab 225. The steeper slope side of the nub 215 may be employed to compress the tab 225 when going from a locked to an unlocked state. This may increase the amount of torque needed to unlock the radial locking system by causing the tab 225 to more rapidly compress as the nub 215 moves underneath the tab 225.

The radial lock(s) 215, 225 may provide for a more robust connection between the covering portions 210, 220 and may also provide feedback to a user that the covering portions 210, 220 have been connected. The radial locks 215, 225 may also discourage over-tightening of the covering portions 210, 220.

The radial locks 215, 225 may also provide structural support to prevent the covering portions 210, 220 from opening, disconnecting, or becoming damaged as a result of certain torqueing events. In one configuration, four pairs of radial locks 215, 225 may be provided at approximately 90° from each other, thereby creating two opposing sets of pairs at approximately 180° from each other. This configuration may provide additional strength by matching a pulling force on one of the locks against a pushing force of the other lock 180° away.

The first or second covering portions 210, 220 may include a hanger 226 (shown as part of second covering portion 220). The hanger 226 may facilitate hanging or attachment of the system 200 to other items or structures (for example, a nail or twine).

Figure 2A:
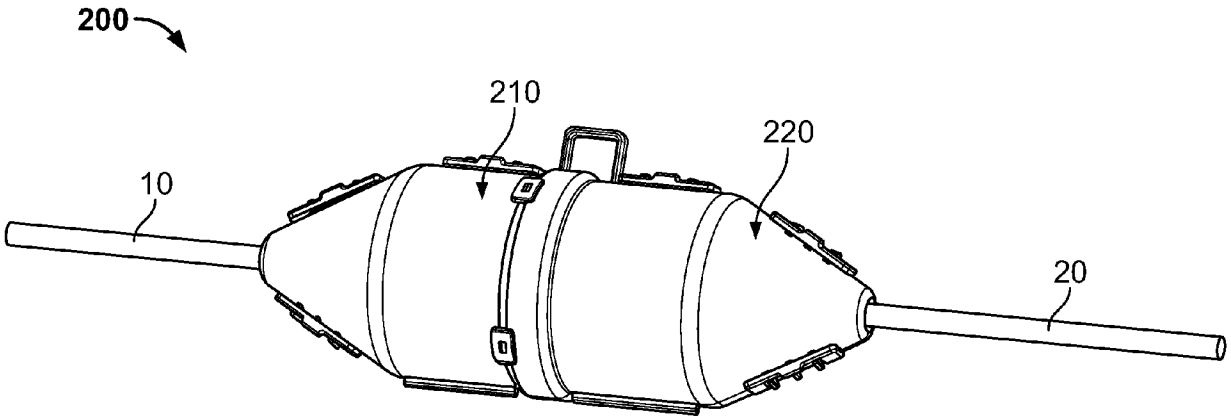
FIG. 2A shows a perspective view of a system for covering a connection of electrical cords in which two covering portions are mated, according to techniques of the present application.
Figure 2B:
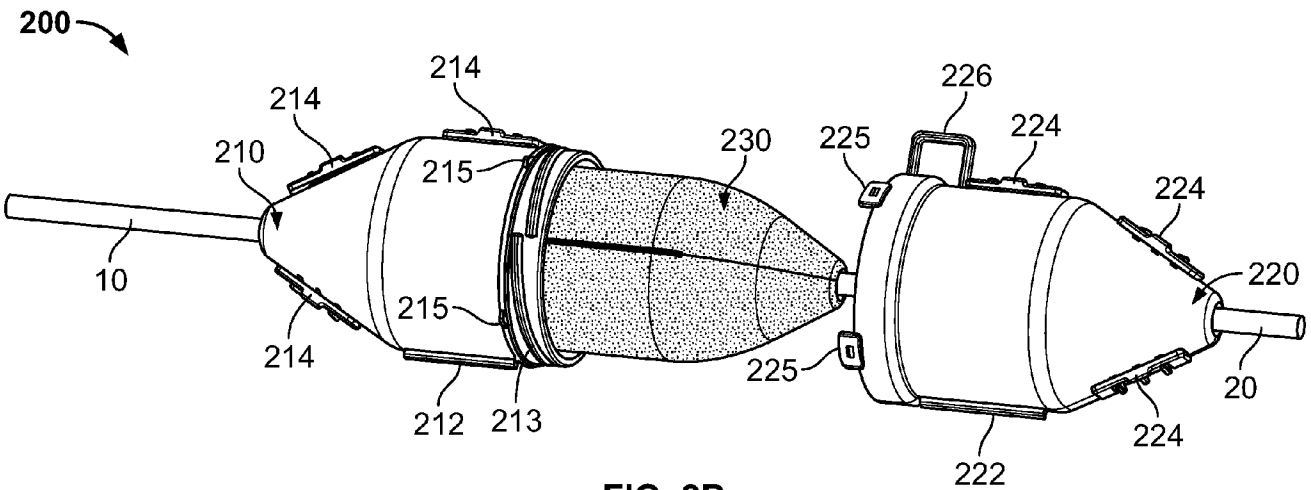
FIG. 2B shows a perspective view of a system for covering a connection of electrical cords in which two covering portions are not mated, according to techniques of the present application.
Figure 2C:
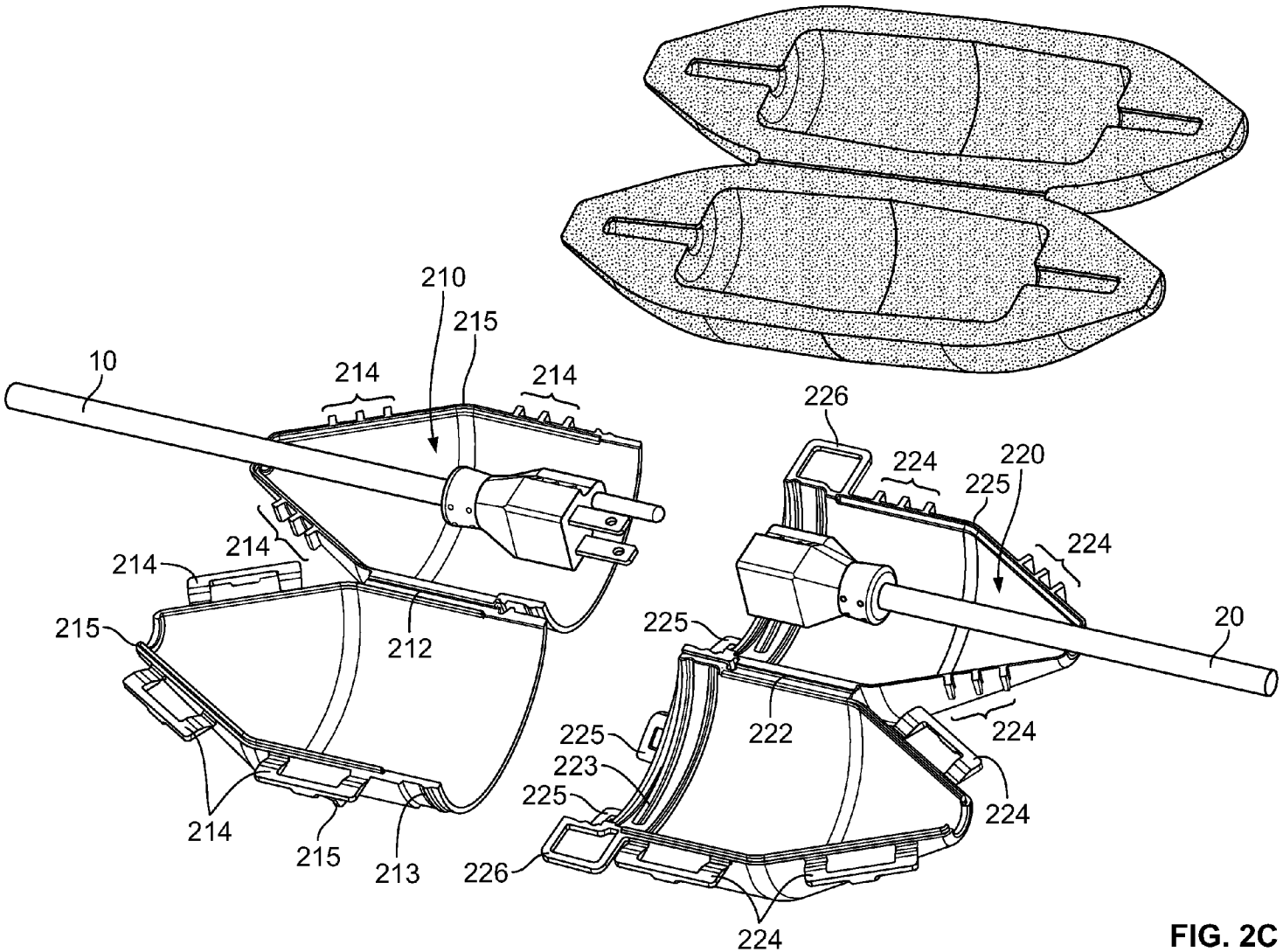
FIG. 2C shows a perspective view of a system for covering a connection of electrical cords in which two covering portions are not mated, according to techniques of the present application.

The compression portion 230 may accommodate the plugs and cords 10, 11, 20, 21, for example, with a hollow interior region. The compression portion 230 may nest (at least partially) within the interior regions of the covering portions 210, 220. The compression portion 230 may surround the portion of the cable 10 and the plug 11 of the first electrical cord accommodated by the interior region of the first covering portion 110. The compression portion 230 may be formed of two parts, such as a left and right part similar compression portion 130, 140. The compression portion 230 may be formed of a top and bottom part, either separate or connected by a hinge as shown in FIG. 2C. Such a hinge may be a living hinge, and the compression portion 230 may be formed from one piece of compressible material.

The compression portion 230 may include foam such as closed-cell foam, which may inhibit or prevent the absorption of liquids such as water. The foam may repel water, which may bead once hitting the foam and then roll off of the foam. Due to the compressibility of the foam, the compression portion 230 may be self-adjusting, thereby facilitating the formation of seals around different size cords or wires, such as 14, 16, 18, 20, 22, or 24 gauge wires or cords.

The compression portion 230 may have a density of approximately 2 $lbs/ft^3$ and a tensile strength of approximately 35 psi.

The compression portion 230 may have an elongation of approximately 160% and a tear resistance of approximately 7. The compression portion 230 may have compression strengths as follows: approximately 4.5 psi at 10% deflection; approximately 7 psi at 25% deflection, approximately 11 psi at 40% deflection, and approximately 15 psi at 50% deflection. The compression portion 230 may have a compression set of approximately 16% and a thermal stability of less than approximately 3% change over 24 hours at 158° F. Such specifications may be determined according to the ASTM D3575 standard.

As shown in FIG. 2C, the hollow interior region of the compression portion 230 may have a plug-accommodating hollow region that accommodates the plugs 11, 21 and cord-accommodating hollow regions (for example, two crevices), which accommodate portions of the cords 10, 20. The cord-accommodating hollow regions may each extend from the plug-accommodating hollow region toward different ends (for example, opposite ends) of the compression portion 230.

The cord-accommodating regions may not extend all of the distance to the ends. For example, as shown in FIG. 2C, there may not be a hollow region within the compression portion 230 between one or more ends and the furthest extent of the hollow interior region (for example, the furthest extent of the cord-accommodating hollow regions). This may facilitate formation of a seal around the cords 10, 20 to form a seal to inhibit the penetration of moisture into the hollow interior region of the compressible portion 230 and towards the connection of the plugs 11, 21.

Figure 2D:
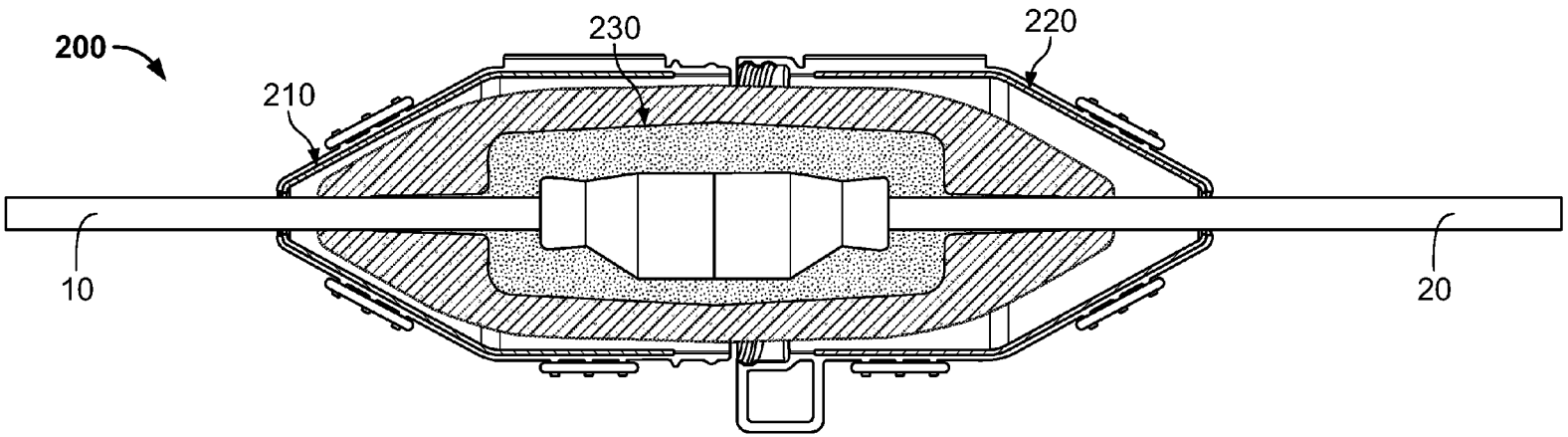
FIG. 2D shows a cross-sectional view of a system for covering a connection of electrical cords in which two covering portions are not mated, according to techniques of the present application.
Figure 2E:
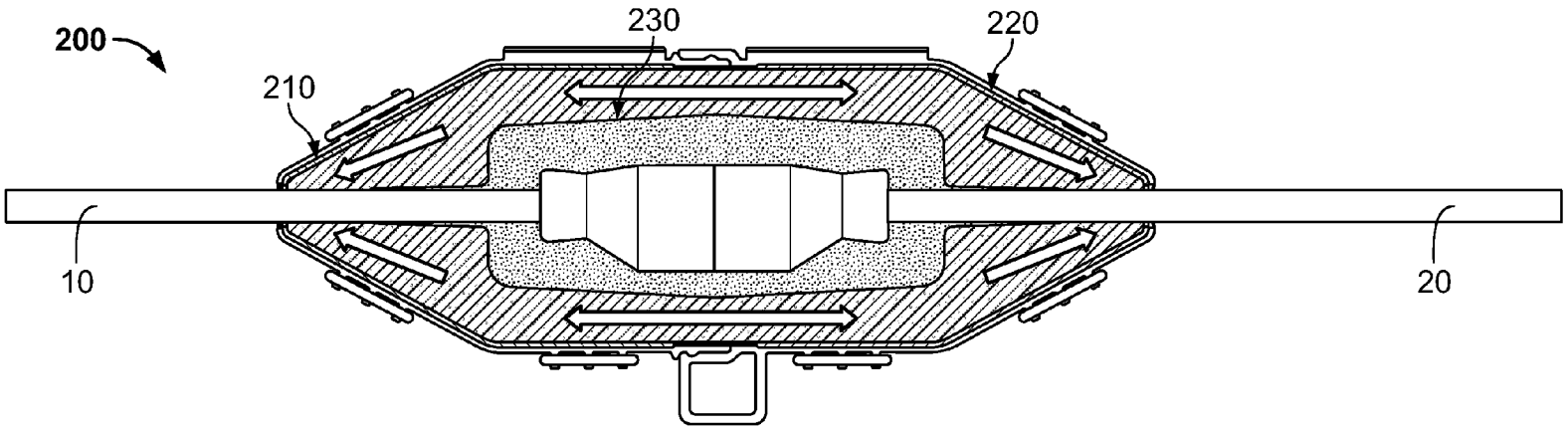
FIG. 2E shows a cross-sectional view of a system for covering a connection of electrical cords in which two covering portions are mated, according to techniques of the present application.

FIG. 2D shows a cross-sectional view of the system 200 before the covering portions 210, 220 are mated. FIG. 2E shows a cross-sectional view of the system 200 after the covering portions 210, 220 are mated. After mating via the mating portions 213 and 223, the compression portion 230 may compress (as illustrated by the arrows in FIG. 2E) and fill in voids in the interior regions of the covering portions 210, 220 (for example, near the cable apertures). This compression (for example, radial compression) may also form seals at the cable apertures.

The first and second covering portions 210, 220 may mate through mating portions 213, 223 (for example, complimentary screw threads) which screw together (for example, ¼ turn). As the covering portions 210, 220 are connected they may exert a radial compression force upon the compression portion 230 causing it to fill in the voids around the cables 10, 20 and the other openings along the compression portion 230 resulting in a substantially water or weather resistant seal around the electrical connection between the plugs 11, 21.

Though not shown, the system 200 may employ keyways, such as those shown in system 100. Furthermore, various features in either system 100 or 200 may be interchangeable or equally applicable to the other of system 100 or 200. For example, a hanger such as hanger 226 may also be employed in system 100.

The system 200 shown in FIGS. 2A-2E may be used in the following manner. The compression portion 230 has a top and bottom portion and a living clam shell hinge. The top portion and the bottom portion are opened with respect to each other, thereby revealing the hollow interior region. The cables 10, 20 and plugs 11, 21 of the first and second electrical cords are placed in the compression portion 230. The compression portion 230 is then placed in the first covering portion 210.

The first covering portion 210 is then mated with the second covering portion 220 with their respective threads 213, 223 by turning the covering portions 210, 220 ¼ turn with respect to each other. During the mating process, four nubs 215 on the first covering portion 210 force outwardly (along a radial direction) four corresponding tabs 225 on the second covering portion 220. The tabs 225 become compressed until the nubs 215 enter corresponding openings in the tabs 225. At this time, the tabs 225 decompress, thereby locking the nubs 215 and tabs 225 (and thereby locking the first covering portion 210 and the second covering portion 220).

While the invention has been described with reference to certain techniques, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular technique disclosed, but that the invention will include all techniques falling within the scope of the appended claims.

The invention claimed is:

1. An electrical cord covering system for covering a connection of a first electrical cord including a first plug and a first cable with a second electrical cord including a second plug and a second cable, wherein the electrical cord covering system comprises:

a first covering portion including:

a first interior region configured to accommodate a portion of the first cable and the first plug, a first cable aperture arranged to accommodate the first cable, a first plug aperture arranged to permit the first plug to mate with the second plug, wherein the first plug aperture includes an opening between the first interior region and a region exterior to the first covering portion, and a first mating portion proximate to the first plug aperture;

a second covering portion detachable from the first covering portion and including:

a second interior region configured to accommodate a portion of the second cable and the second plug, a second cable aperture arranged to accommodate the second cable, a second plug aperture different from the first plug aperture and arranged to permit the second plug to mate with the first plug, wherein the second plug aperture includes an opening between the second interior region and a region exterior to the second covering portion, and a second mating portion proximate to the second plug aperture and configured to mate with the first mating portion;

a compression portion configured to:

nest at least partially within the first interior region and the second interior region, surround the portion of the first cable and the first plug accommodated by the first interior region, and surround the portion of the second cable and the second plug accommodated by the second interior region; and when the first mating portion and the second mating portion are mated, the compression portion is further configured to form a seal at the first cable aperture around the first cable and a seal at the second cable aperture around the second cable.

2. The electrical cord covering system of claim 1, further comprising at least one radial lock on the first covering portion and the second covering portion, wherein the at least one radial lock is configured to lock the first covering portion with the second covering portion when the first mating portion is mated with the second mating portion.

3. The electrical cord covering system of claim 2, wherein the at least one radial lock comprises at least one nub on the first covering portion and at least one tab including a hole on the second covering portion.

4. The electrical cord covering system of claim 3, wherein each of the at least one nub comprises a side with a steeper slope and a side with a shallower slope.

5. The electrical cord covering system of claim 4, wherein at least one of:

the side with a steeper slope of the at least one nub is employed to compress a corresponding one of the at least one tab while unlocking a corresponding at least one radial lock; or the side with a steeper slope of the at least one nub is employed to compress a corresponding one of the at least one tab while unlocking a corresponding at least one radial lock.

6. The electrical cord covering system of claim 5, wherein the side with a steeper slope of the at least one nub is employed to compress a corresponding one of the at least one tab while unlocking a corresponding at least one radial lock; and the side with a steeper slope of the at least one nub is employed to compress a corresponding one of the at least one tab while unlocking a corresponding at least one radial lock.

7. The electrical cord covering system of claim 2, wherein the at least one radial lock comprises four radial locks.

8. The electrical cord covering system of claim 1, wherein the compression portion comprises foam.

9. The electrical cord covering system of claim 1, wherein the compression portion comprises a top part and a bottom part connected by a living hinge.

10. The electrical cord covering system of claim 1, wherein the compression portion comprises a hollow interior region configured to accommodate the first plug and the second plug.

11. An electrical cord covering system for covering a connection of a first electrical cord including a first plug and a first cable with a second electrical cord including a second plug and a second cable, wherein the electrical cord covering system comprises:

a first covering portion including:

a first interior region configured to accommodate a portion of the first cable and the first plug, a first cable aperture arranged to accommodate the first cable, a first plug aperture arranged to permit the first plug to mate with the second plug, wherein the first plug aperture includes an opening between the first interior region and a region exterior to the first covering portion, and a first mating portion proximate to the first plug aperture;

a second covering portion detachable from the first covering portion and including:

a second interior region configured to accommodate a portion of the second cable and the second plug, a second cable aperture arranged to accommodate the second cable, a second plug aperture different from the first plug aperture and arranged to permit the second plug to mate with the first plug, wherein the second plug aperture includes an opening between the second interior region and a region exterior to the second covering portion, and a second mating portion proximate to the second plug aperture and configured to mate with the first mating portion;

a first compression portion configured to:

nest at least partially within the first interior region, surround the portion of the first cable and the first plug accommodated by the first interior region;

a second compression portion configured to:

nest at least partially within the second interior region, surround the portion of the second cable and the second plug accommodated by the second interior region; and when the first mating portion and the second mating portion are mated:

the first compression portion is further configured to form a seal at the first cable aperture and around the first cable, the second compression portion is further configured to form a seal at the second cable aperture and around the second cable, and the first compression portion and the second compression portion are further configured to form a seal at the first plug aperture and the second plug aperture around the first plug and the second plug.

12. The electrical cord covering system of claim 11, wherein:

the first compression portion and the first covering portion comprise matching keyways; and the second compression portion and the second covering portion comprise matching keyways.

13. The electrical cord covering system of claim 11, wherein the first compression portion and the second compression portion each comprise foam.

* * * * *